US012121972B1

(12) United States Patent
Kido et al.

(10) Patent No.: US 12,121,972 B1
(45) Date of Patent: Oct. 22, 2024

(54) CEMENTED CARBIDE AND CUTTING TOOL USING THE SAME

(71) Applicant: Sumitomo Electric Industries, Ltd., Osaka (JP)

(72) Inventors: Yasuki Kido, Osaka (JP); Yoshihiro Kimura, Osaka (JP); Anongsack Paseuth, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/576,745

(22) PCT Filed: Jun. 21, 2023

(86) PCT No.: PCT/JP2023/022968
§ 371 (c)(1),
(2) Date: Jan. 5, 2024

(51) Int. Cl.
*C22C 29/08* (2006.01)
*B22F 5/00* (2006.01)

(52) U.S. Cl.
CPC ..... *B22F 5/00* (2013.01); *C22C 29/08* (2013.01); *B22F 2005/001* (2013.01); *B22F 2302/10* (2013.01)

(58) Field of Classification Search
CPC ..... C22C 29/08
See application file for complete search history.

(56) References Cited

U.S. PATENT DOCUMENTS 5,421,852 A * 6/1995 Maruyama ..... C22C 29/08 75/242
2006/0048604 A1* 3/2006 Norgren ..... C22C 29/067 75/241
2010/0098506 A1* 4/2010 Tanaka ..... B22F 1/07 407/53

FOREIGN PATENT DOCUMENTS

JP H11-350061 A 12/1999
JP 2004-162080 A 6/2004
(Continued)

OTHER PUBLICATIONS

Written Opinion mailed on Sep. 12, 2023, received for PCT Application PCT/JP2023/022968, filed on Jun. 21, 2023, 6 pages including English Translation.

*Primary Examiner* — Christopher S Kessler
(74) *Attorney, Agent, or Firm* — XSENSUS LLP

(57) ABSTRACT

A cemented carbide comprising a plurality of tungsten carbide particles and a binder phase, wherein in a first region of a first graph showing results obtained by carrying out line analysis along a first direction going from position X1 provided in the tungsten carbide particles to position X2 provided in the binder phase adjacent to the tungsten carbide particles, a distance $P_W$ at a maximum intensity $I_W$ of tungsten, a maximum distance $P_{W70}$ showing an intensity $I_{W70}$ of 70% of the maximum intensity $I_W$, a distance $P_V$ at a maximum intensity $I_V$ of vanadium, a distance $P_{Cr}$ at a maximum intensity $I_{Cr}$ of chromium, a minimum distance $P_{Co70}$ showing an intensity $I_{Co70}$ of 70% of a maximum intensity $I_{Co}$ of cobalt, and a distance $P_{Co}$ at the maximum intensity $I_{Co}$ show a relationship $P_W<P_{W70}<P_V<P_{Cr}<P_{Co70}<P_{Co}$.

8 Claims, 5 Drawing Sheets

(56) References Cited

FOREIGN PATENT DOCUMENTS

| | | | |
|---|---|---|---|
| JP | 2004-256852 | A | 9/2004 |
| JP | 2006-131974 | A | 5/2006 |
| JP | 2016-098393 | A | 5/2016 |
| JP | 2021-110010 | A | 8/2021 |
| WO | 2009/001929 | A1 | 12/2008 |

* cited by examiner

CEMENTED CARBIDE AND CUTTING TOOL USING THE SAME

CROSS-REFERENCE TO RELATED APPLICATION

The present application is based on PCT filing PCT/JP2023/022968, filed Jun. 21, 2023, the entire contents of which are incorporated herein by reference.

TECHNICAL FIELD

The present disclosure relates to a cemented carbide and a cutting tool using the same.

BACKGROUND ART

Conventionally, a cemented carbide including a tungsten carbide (WC) particle and a binder phase including cobalt as a main component has been used as a material for a cutting tool (PTL 1 and PTL 2).

CITATION LIST

Patent Literature

PTL 1: Japanese Patent Laying-Open No. 2016-098393
PTL 2: Japanese Patent Laying-Open No. 2021-110010

SUMMARY OF INVENTION

The cemented carbide according to the present disclosure is a cemented carbide comprising a plurality of tungsten carbide particles and a binder phase, wherein the cemented carbide comprises a total of 80% by volume or more of the tungsten carbide particles and the binder phase, the cemented carbide comprises 0.1% by volume or more and 20% by volume or less of the binder phase, the cemented carbide comprises 0.03 atomic % or more and 0.90 atomic % or less of vanadium, the cemented carbide comprises 0.01 atomic % or more and 1.20 atomic % or less of chromium, the binder phase comprises 50% by mass or more of cobalt, and in a first region of a first graph showing results obtained by carrying out line analysis by using an energy dispersive X-ray spectrometer attached to a transmission electron microscope along a first direction going from position X1 provided in the tungsten carbide particles to position X2 provided in the binder phase adjacent to the tungsten carbide particles, in a coordinate system where an X axis is a distance from position X1 and a Y axis is an intensity, a distance $P_W$ at a maximum intensity $I_W$ of tungsten, a maximum distance $P_{W70}$ showing an intensity $I_{W70}$ of 70% of the maximum intensity $I_W$, a distance $P_V$ at a maximum intensity $I_V$ of vanadium, a distance $P_{Cr}$ at a maximum intensity $I_{Cr}$ of chromium, a minimum distance $P_{Co70}$ showing an intensity $I_{Co70}$ of 70% of a maximum intensity $I_{Co}$ of cobalt, and a distance $P_{Co}$ at the maximum intensity $I_{Co}$ show a relationship $P_W<P_{W70}<P_V<P_{Cr}<P_{Co70}<P_{Co}$, and the first region is a region between a distance P1, which is a distance of 3 nm from the $P_V$ toward an origin side of the coordinate system, and a distance P2, which is a distance of 3 nm from the $P_V$ toward an opposite side of the origin, on the X axis in the first graph.

DETAILED DESCRIPTION

Figure 1:
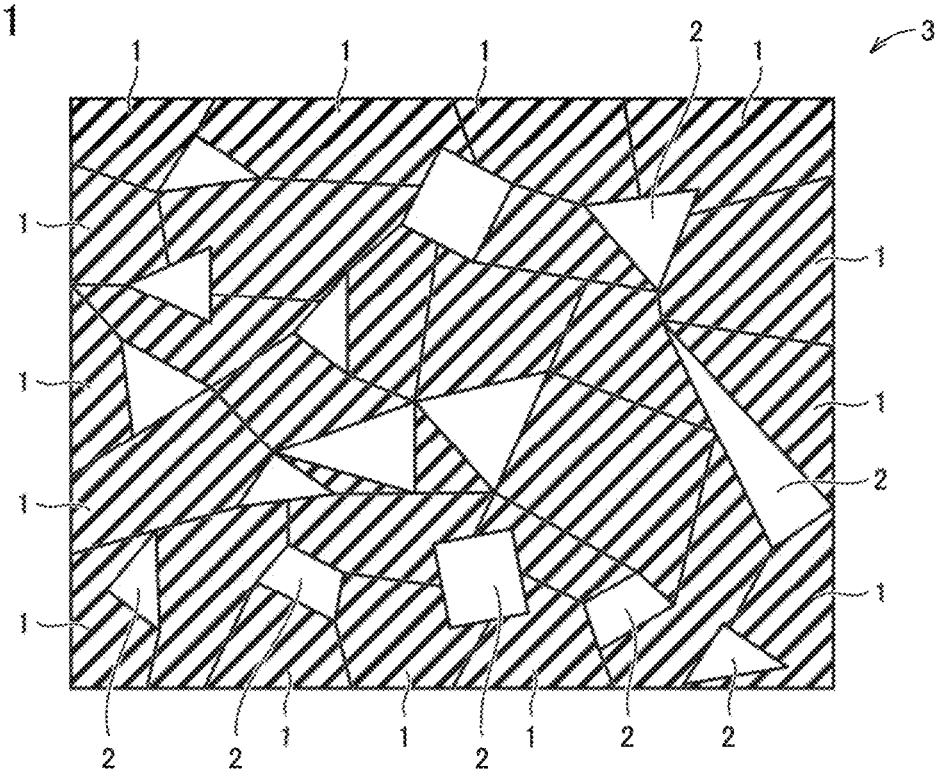
FIG. 1 is a schematic cross-sectional view of a cemented carbide according to Embodiment 1.

Problem to be Solved by the Present Disclosure

With the expansion of 5G (5th generation mobile communication system), the demand for a semiconductor package substrate is increasing. A semiconductor package substrate is subjected to drill working using a small-diameter drill. From the viewpoint of cost reduction, there is a demand for a cutting tool that has a long life even when used for processing a semiconductor package substrate.

Therefore, an object of the present disclosure is to provide a cemented carbide that can provide a cutting tool that has a long tool life, particularly even in processing a semiconductor package substrate, when used as a material for a cutting tool, and a cutting tool including the same.

Advantageous Effect of the Present Disclosure

According to the present disclosure, it is possible to provide a cemented carbide that can provide a cutting tool that has a long tool life, particularly even in processing a semiconductor package substrate, when used as a material for a cutting tool, and a cutting tool including the same.

DESCRIPTION OF EMBODIMENTS

First, aspects of the present disclosure will be listed and described.

(1) The cemented carbide according to the present disclosure is a cemented carbide comprising a plurality of tungsten carbide particles and a binder phase, wherein the cemented carbide comprises a total of 80% by volume or more of the tungsten carbide particles and the binder phase, the cemented carbide comprises 0.1% by volume or more and 20% by volume or less of the binder phase, the cemented carbide comprises 0.03 atomic % or more and 0.90 atomic % or less of vanadium, the cemented carbide comprises 0.01 atomic % or more and 1.20 atomic % or less of chromium, the binder phase comprises 50% by mass or more of cobalt, and in a first region of a first graph showing results obtained by carrying out line analysis by using an energy dispersive X-ray spectrometer attached to a transmission electron microscope along a first direction going from position X1 provided in the tungsten carbide particles to position X2 provided in the binder phase adjacent to the tungsten carbide particles, in a coordinate system where an X axis is a distance from position X1 and a Y axis is an intensity, a distance $P_W$ at a maximum intensity $I_W$ of tungsten, a maximum distance $P_{W70}$ showing an intensity $I_{W70}$ of 70% of the maximum intensity $I_W$, a distance $P_V$ at a maximum intensity $I_V$ of vanadium, a distance $P_{Cr}$ at a maximum intensity $I_{Cr}$ of chromium, a minimum distance $P_{Co70}$ showing an intensity $I_{Co70}$ of 70% of a maximum intensity $I_{Co}$ of cobalt, and a distance $P_{Co}$ at the maximum intensity $I_{Co}$ show a relationship $P_W<P_{W70}<P_V<P_{Cr}<P_{Co70}<P_{Co}$, and the first region is a region between a distance P1, which is a distance of 3 nm from the $P_V$ toward an origin side of the coordinate system, and a distance P2, which is a distance of 3 nm from the $P_V$ toward an opposite side of the origin, on the X axis in the first graph.

According to the present disclosure, it is possible to provide a cemented carbide that can provide a cutting tool that has a long tool life, particularly even in processing a semiconductor package substrate, when used as a material for a cutting tool, and a cutting tool including the same.

(2) In (1) above, the vanadium atom located at the $P_V$ and the chromium atom located at the $P_{Cr}$ may be present at a W site of tungsten carbide.

(3) In (1) or (2) above, the cemented carbide may include 18% by volume or less of the binder phase. According to this, the tool life is further improved.

(4) The cutting tool according to the present disclosure is a cutting tool comprising a cutting edge formed from the cemented carbide according to any of (1) to (3) above.

The cutting tool according to the present disclosure can have a long tool life, particularly even when used for working of a semiconductor package substrate.

Details of the Embodiments of the Present Disclosure

With reference to the drawings, specific examples of the cemented carbide and the cutting tool according to the present disclosure will be described below. In the drawings of the present disclosure, the same reference signs represent the same portions or equivalent portions. In addition, a dimensional relationship such as length, width, thickness, or depth is appropriately changed for clarity and simplification of the drawings, and does not necessarily represent an actual dimensional relationship.

As used in the present disclosure, the expression of a range in the format "A to B" means the upper limit and the lower limit of the range (that is, A or more and B or less), and when no unit is written in A and a unit is only written in B, the unit for A and the unit for B are the same.

As used in the present disclosure, when a compound or the like is represented by a chemical formula, if the atomic ratio is not particularly limited, the chemical formula shall include all conventionally known atomic ratios, and should not necessarily be limited only to those within the stoichiometric range.

As used in the present disclosure, when one or more numerical values are written as each of the lower limit and the upper limit of a numerical range, a combination of any one numerical value written as the lower limit and any one numerical value written as the upper limit shall also be disclosed. For example, when a1 or more, b1 or more, and c1 or more are written as the lower limit, and a2 or less, b2 or less, and c2 or less are written as the upper limit, a1 or more and a2 or less, a1 or more and b2 or less, a1 or more and c2 or less, b1 or more and a2 or less, b1 or more and b2 or less, b1 or more and c2 or less, c1 or more and a2 or less, c1 or more and b2 or less, and c1 or more and c2 or less shall be disclosed.

Embodiment 1: Cemented Carbide

The cemented carbide according to one embodiment of the present disclosure (hereinafter also referred to as "Embodiment 1") is a cemented carbide comprising a plurality of tungsten carbide particles and a binder phase, wherein the cemented carbide comprises a total of 80% by volume or more of the tungsten carbide particles and the binder phase, the cemented carbide comprises 0.1% by volume or more and 20% by volume or less of the binder phase, the cemented carbide comprises 0.03 atomic % or more and 0.90 atomic % or less of vanadium, the cemented carbide comprises 0.01 atomic % or more and 1.20 atomic % or less of chromium, the binder phase comprises 50% by mass or more of cobalt, and in a first region of a first graph showing results obtained by carrying out line analysis by using an energy dispersive X-ray spectrometer attached to a transmission electron microscope along a first direction going from position X1 provided in the tungsten carbide particles to position X2 provided in the binder phase adjacent to the tungsten carbide particles, in a coordinate system where an X axis is a distance from position X1 and a Y axis is an intensity, a distance $P_W$ at a maximum intensity $I_W$ of tungsten, a maximum distance $P_{W70}$ showing an intensity $I_{W70}$ of 70% of the maximum intensity $I_W$, a distance $P_V$ at a maximum intensity $I_V$ of vanadium, a distance $P_{Cr}$ at a maximum intensity $I_{Cr}$ of chromium, a minimum distance $P_{Co70}$ showing an intensity $I_{Co70}$ of 70% of a maximum intensity $I_{Co}$ of cobalt, and a distance $P_{Co}$ at the maximum intensity $I_{Co}$ show a relationship $P_W<P_{W70}<P_V<P_{Cr}<P_{Co70}<P_{Co}$, and the first region is a region between a distance P1, which is a distance of 3 nm from the $P_V$ toward an origin side of the coordinate system, and a distance P2, which is a distance of 3 nm from the $P_V$ toward an opposite side of the origin, on the X axis in the first graph.

The cemented carbide of Embodiment 1 can provide a cutting tool that has a long tool life, particularly even in processing a semiconductor package substrate, when used as a material for a cutting tool. Although the reason for this is not clear, it is presumed as follows.

The cemented carbide of Embodiment 1 includes a plurality of tungsten carbide particles (hereinafter also referred to as "WC particles") and a binder phase, and the total content of the WC particles and binder phase in the cemented carbide is 80% by volume or more. According to this, the cemented carbide has high hardness and strength, and a cutting tool using the cemented carbide can have excellent wear resistance and breakage resistance.

The cemented carbide of Embodiment 1 includes 0.1% by volume or more and 20% by volume or less of the binder phase, and the binder phase includes 50% by mass or more of cobalt. According to this, the cemented carbide has high hardness and strength, and a cutting tool using the cemented carbide can have excellent wear resistance and breakage resistance.

The cemented carbide of Embodiment 1 includes 0.03 atomic % or more and 0.90 atomic % or less of vanadium, and 0.01 atomic % or more and 1.20 atomic % or less of chromium. Vanadium and chromium have the action of suppressing grain growth of tungsten carbide particles. Furthermore, the cemented carbide of Embodiment 1 shows the relationship $P_W<P_{W70}<P_V<P_{Cr}<P_{Co70}<P_{Co}$. Thereby, the action of suppressing grain growth of tungsten carbide particles is further improved. Therefore, in the cemented carbide of Embodiment 1, the formation of an abnormal structure due to the generation of a coarse particle is suppressed, and a cutting tool using the cemented carbide can have excellent breakage resistance.

<Composition of Cemented Carbide>

As shown in FIG. 1, a cemented carbide 3 of Embodiment 1 includes a plurality of tungsten carbide particles 1 (hereinafter also referred to as "WC particles") and a binder phase 2, wherein the total content of the WC particles and the binder phase in cemented carbide 3 is 80% by volume or more. The lower limit of the total content of the WC particles and the binder phase in the cemented carbide may be 82% by volume or more, 84% by volume or more, 85% by volume or more, or 86% by volume or more. The upper limit of the total content of the WC particles and the binder phase in the cemented carbide may be 100% by volume or less. The upper limit of the total content of the WC particles and the binder phase in the cemented carbide may be 99% by volume or less, or 98% by volume or less, from the viewpoint of manufacturing. The total content of the WC particles and the binder phase in the cemented carbide may be 80% by volume or more and 100% by volume or less, 82% by volume or more and 100% by volume or less, or 84% by volume or more and 100% by volume or less.

The cemented carbide of Embodiment 1 can consist of a plurality of tungsten carbide particles and a binder phase. The cemented carbide of the present embodiment can include a different phase in addition to the tungsten carbide particles and the binder phase. Examples of the composition of the different phase include TiCN and TaC.

The cemented carbide of Embodiment 1 can consist of the tungsten carbide particles, the binder phase, and a different phase. Any content of the different phase in the cemented carbide is allowed as long as it does not impair the effect of the present disclosure. For example, the content of the different phase in the cemented carbide may be 0% by volume or more and 20% by volume or less, 0% by volume or more and 18% by volume or less, or 0% by volume or more and 16% by volume or less. In this case, the total content of the WC particles and the binder phase in the cemented carbide may be 80% by volume or more and less than 100% by volume, 82% by volume or more and less than 100% by volume, or 84% by volume or more and less than 100% by volume.

The cemented carbide of Embodiment 1 can include an impurity. Examples of the impurity include calcium (Ca) and sulfur (S). Any content of the impurity in the cemented carbide is allowed as long as it does not impair the effect of the present disclosure. For example, the content of the impurity in the cemented carbide is preferably 0% by mass or more and less than 0.1% by mass. The content of the impurity in the cemented carbide is measured by ICP emission spectroscopy (Inductively Coupled Plasma Emission Spectroscopy (measuring apparatus: "ICPS-8100" (trademark) of Shimadzu Corporation)).

The lower limit of the content of the tungsten carbide particles in the cemented carbide of Embodiment 1 may be 60% by volume or more, 62% by volume or more, 64% by volume or more, or 68% by volume or more. The upper limit of the content of the tungsten carbide particles in the cemented carbide may be 99.9% by volume or less, 99.2% by volume or less, 99% by volume or less, 98% by volume or less, 96% by volume or less, or 94% by volume or less. The content of the tungsten carbide particles in the cemented carbide may be 60% by volume or more and 99.9% by volume or less, 60% by volume or more and 99.2% by volume or less, 64% by volume or more and 96% by volume or less, or 68% by volume or more and 94% by volume or less.

The cemented carbide of Embodiment 1 includes 0.1% by volume or more and 20% by volume or less of the binder phase. From the viewpoint of improving toughness, the lower limit of the content of the binder phase in the cemented carbide is 0.1% by volume or more, and may be 1% by volume or more, 2% by volume or more, 3% by volume or more, 4% by volume or more, or 8% by volume or more. From the viewpoint of improving hardness, the upper limit of the content of the binder phase in the cemented carbide is 20% by volume or less, and may be 19% by volume or less, 18% by volume or less, 17% by volume or less, 16% by volume or less, or 15% by volume or less. The content of the binder phase in the cemented carbide may be 0.1% by volume or more and 18% by volume or less, 1% by volume or more and 18% by volume or less, 3% by volume or more and 17% by volume or less, 4% by volume or more and 16% by volume or less, or 8% by volume or more and 15% by volume or less. When the content of the binder phase in the cemented carbide is 18% by volume or less, the hardness of the cemented carbide is further improved, and the wear resistance is further improved, and thus the tool life of a cutting tool using the cemented carbide as a material is further improved.

The method for measuring the content (% by volume) of the tungsten carbide particles in the cemented carbide and the content (% by volume) of the binder phase in the cemented carbide is as follows.

(A1) The cemented carbide is cut out at an arbitrary position to expose a cross section. The cross section is mirror-finished with a cross-section polisher (manufactured by JEOL Ltd.).

(B1) The mirror-finished surface of the cemented carbide is analyzed by using a scanning electron microscope-energy dispersive X-ray spectroscopy (SEM-EDX) (apparatus: Gemini 450 (trademark) manufactured by Carl Zeiss AG) to identify an element included in the cemented carbide.

(C1) The mirror-finished surface of the cemented carbide is photographed with a scanning electron microscope (SEM) to obtain a backscattered electron image. The photographing region of the photographed image is set to the central part of the cross section of the cemented carbide, that is, a position that does not include a portion that clearly differs in a property from a bulk portion, such as the vicinity of the surface of the cemented carbide, (a position where the entire photographing region is the bulk portion of the cemented carbide). The observation magnification is 5000 times. The measurement conditions are an acceleration voltage of 3 kV, a current value of 2 nA, and a working distance (WD) of 5 mm.

(D1) The photographing region of (C1) above is analyzed by using an energy dispersive X-ray analyzer attached to the SEM (SEM-EDX) to identify the distribution of the element identified in (B1) above in the photographing region and obtain an elemental mapping image.

(E1) The backscattered electron image obtained in (C1) above is taken into a computer and subjected to binarization processing by using image analysis software (OpenCV, SciPy). On the image after binarization processing, the tungsten carbide particles are shown in white and the binder phase is shown in gray to black. The binarization threshold varies depending on the contrast, and thus is set for each image.

(F1) The elemental mapping image obtained in (D1) above and the image after binarization processing obtained in (E1) above are superimposed to identify regions in which the tungsten carbide particles and the binder phase, respectively, are present in the image after binarization processing. Specifically, the region which is shown in white in the image after binarization processing and in which tungsten (W) and carbon (C) are present in the elemental mapping image corresponds to the region in which the tungsten carbide particles are present. The region which is shown in gray to black in the image after binarization processing and in which cobalt (Co) is present in the elemental mapping image corresponds to the region in which the binder phase is present.

(G1) One rectangular measurement field of view of 24.9 μm×18.8 μm is set in the image after binarization processing. By using the image analysis software, the area percentage of each of the tungsten carbide particles and the binder phase is measured with the area of the entire measurement field of view as the denominator.

(H1) The measurement of (G1) above is carried out in 5 different measurement fields of view that do not overlap each other. Herein, the average of the area percentages of the tungsten carbide particles in the 5 measurement fields of view corresponds to the content (% by volume) of the tungsten carbide particles in the cemented carbide, and the average of the area percentages of the binder phase in the 5 measurement fields of view corresponds to the content (% by volume) of the binder phase in the cemented carbide.

When the cemented carbide includes a different phase in addition to the WC particles and the binder phase, the content of the different phase in the cemented carbide can be obtained by subtracting the content (% by volume) of the tungsten carbide particles and the content (% by volume) of the binder phase measured by the above procedure from the entire cemented carbide (100% by volume).

As long as the applicant has carried out the measurement, it has been confirmed that as long as the measurement is carried out on the same sample, even if the cut-out location of the cross section of the cemented carbide, the photographing region described in (C1) above, and the measurement field of view described in (G1) above are arbitrarily set to measure the content of the tungsten carbide particles and the content of the binder phase in the cemented carbide a plurality of times according to the above procedure, there is little variation in the measurement results, and that even if the cut-out location of the cross section of the cemented carbide, the photographing region, and the measurement field of view are arbitrarily set, it will not be contrived.

<Tungsten Carbide Particles>

In Embodiment 1, the tungsten carbide particles include at least any of "pure WC particles (also including WC containing no impurity element and WC in which the content of an impurity element is below the detection limit)" and "WC particles inside which an impurity element is intentionally or unavoidably contained as long as the effect of the present disclosure is not impaired." The content of an impurity in the tungsten carbide particles (when two or more elements constitute the impurity, the total concentration of the elements) is less than 0.1% by mass. The content of the impurity element in the tungsten carbide particles is measured by ICP emission spectrometry.

In Embodiment 1, the average particle diameter of the tungsten carbide particles is not particularly limited. The average particle diameter of the tungsten carbide particles can be, for example, 0.1 μm or more and 3.5 μm or less. It has been confirmed that the cemented carbide of Embodiment 1 can have a long tool life regardless of the average particle diameter of the tungsten carbide particles.

<Binder Phase>

In Embodiment 1, the binder phase includes 50% by mass or more of cobalt. This can impart excellent toughness to the cemented carbide. The lower limit of the cobalt content of the binder phase may be 52% by mass or more, 57% by mass or more, 60% by mass or more, or 63% by mass or more. The upper limit of the cobalt content of the binder phase may be 100% by mass or less, less than 100% by mass, 99% by mass or less, 98% by mass or less, 95% by mass or less, or 90% by mass or less. The cobalt content of the binder phase may be 50% by mass or more and less than 100% by mass, 60% by mass or more and 99% by mass or less, or 63% by mass or more and 98% by mass or less.

The method for measuring the content of cobalt in the binder phase is as follows. In the same manner as in (A1) to (F1) of the method for measuring the content of the tungsten carbide particles, the content of the binder phase, and the content of a hard phase particle in the cemented carbide, the region in which the binder phase is present is identified on an image after binarization processing. The region in which the binder phase is present is analyzed by using SEM-EDX to measure the cobalt content of the binder phase.

As long as the applicant has carried out the measurement, it has been confirmed that as long as the measurement is carried out on the same sample, even if the cut-out location of the cross section of the cemented carbide and the photographing region described in (C1) above are arbitrarily set to measure the content of cobalt in the binder phase a plurality of times according to the above procedure, there is little variation in the measurement results, and that even if the cut-out location of the cross section of the cemented carbide and the photographing region are arbitrarily set, it will not be contrived.

In Embodiment 1, the binder phase can include, in addition to cobalt, at least one first element selected from the group consisting of boron (B), aluminum (Al), silicon (Si), iron (Fe), nickel (Ni), germanium (Ge), ruthenium (Ru), rhenium (Re), osmium (Os), iridium (Ir), and platinum (Pt). The binder phase can consist of cobalt, the first element, and an unavoidable impurity. Examples of the unavoidable impurity include manganese (Mn), magnesium (Mg), calcium (Ca), and sulfur (S).

<Vanadium>

The cemented carbide of Embodiment 1 includes 0.03 atomic % or more and 0.90 atomic % or less of vanadium. From the viewpoint of improving the grain growth suppressing effect, the lower limit of the content of vanadium in the cemented carbide is 0.03 atomic % or more, and may be 0.10 atomic % or more, 0.20 atomic % or more, or 0.30 atomic % or more. From the viewpoint of suppressing the precipitation of a coarse (W, V) C phase, the upper limit of the content of vanadium in the cemented carbide is 0.90 atomic % or less, and may be 0.80 atomic % or less or 0.70 atomic % or less. The content of vanadium in the cemented carbide may be 0.10 atomic % or more and 0.90 atomic % or less, 0.20 atomic % or more and 0.80 atomic % or less, or 0.30 atomic % or more and 0.70 atomic % or less.

The content of vanadium in the cemented carbide is measured by ICP emission spectrometry.

<Chromium>

The cemented carbide of Embodiment 1 includes 0.01 atomic % or more and 1.20 atomic % or less of chromium. From the viewpoint of improving the grain growth suppressing effect, the lower limit of the content of chromium in the cemented carbide is 0.01 atomic % or more, and may be 0.10 atomic % or more or 0.20 atomic % or more. From the viewpoint of suppressing the precipitation of a coarse (W, Cr) C phase, the upper limit of the content of chromium in the cemented carbide is 1.20 atomic % or less, and may be 0.80 atomic % or less or 0.70 atomic % or less. The content of chromium in the cemented carbide may be 0.10 atomic % or more and 0.80 atomic % or less, or 0.20 atomic % or more and 0.70 atomic % or less.

The content of chromium in the cemented carbide is measured by ICP emission spectrometry.

<Line Analysis>

Figure 2:
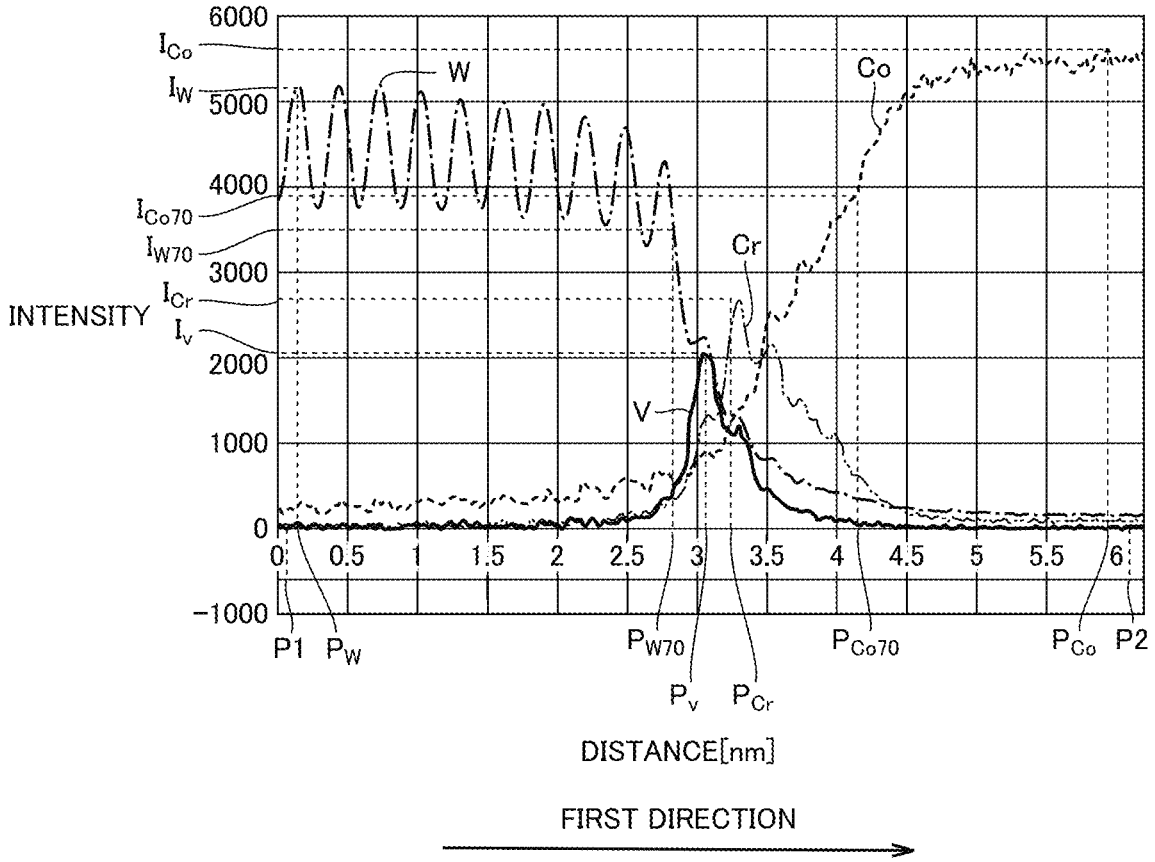
FIG. 2 is a diagram showing an example of the first graph for the cemented carbide according to Embodiment 1.

In the cemented carbide of Embodiment 1, results obtained by carrying out line analysis by using an energy dispersive X-ray spectrometer attached to a transmission electron microscope along a first direction going from position X1 provided in the tungsten carbide particles to position X2 provided in the binder phase adjacent to the tungsten carbide particles will be described with reference to FIG. 2. FIG. 2 is an example of a first graph showing results obtained by carrying out line analysis on the cemented carbide of Embodiment 1 for tungsten, cobalt, vanadium, and cobalt, which are elements included in the cemented carbide, in a coordinate system where the X axis is the distance from position X1 and the Y axis is the intensity. In the cemented carbide shown in FIG. 2, the binder phase is cobalt.

As shown in FIG. 2, in a first region of the first graph, the distance $P_W$ at the maximum intensity $I_W$ of tungsten, the maximum distance $P_{W70}$ showing an intensity $I_{W70}$ of 70% of the maximum intensity $I_W$, the distance $P_V$ at the maximum intensity $I_V$ of vanadium, the distance $P_{Cr}$ at the maximum intensity $I_{Cr}$ of chromium, the minimum distance $P_{Co70}$ showing an intensity $I_{Co70}$ of 70% of the maximum intensity $I_{Co}$ of cobalt, and the distance $P_{Co}$ at the maximum intensity $I_{Co}$ show the relationship $P_W<P_{W70}<P_V<P_{Cr}<P_{Co70}<P_{Co}$. Here, the first region is a region between a distance P1, which is a distance of 3 nm from $P_V$ toward the origin side of the coordinate system, and a distance P2, which is a distance of 3 nm from $P_V$ toward the opposite side of the origin, on the X axis in the first graph. Here, the maximum distance $P_{W70}$ means that when a plurality of distances that show the intensity $I_{W70}$ are present in the first graph, the maximum distance among these distances is the distance $P_{W70}$. In the first graph of FIG. 2, there are four distances that show the intensity $I_{W70}$. The minimum distance $P_{Co70}$ means that when a plurality of distances that show the intensity $I_{Co70}$ are present in the first graph, the minimum distance among these distances is the distance $P_{Co70}$. In the first graph of FIG. 2, there is one distance that shows the intensity $I_{Co70}$.

The relationship $P_W<P_V<P_{Cr}<P_{Co}$ in the relationship $P_W<P_{W70}<P_V<P_{Cr}<P_{Co70}<P_{Co}$ means that in the first region including the interface between the WC particles and the binder phase, the maximum concentration region of vanadium located at the distance $P_V$ is present at a position closer to the WC particles than the maximum concentration region of chromium located at the distance $P_{Cr}$, and the maximum concentration region of chromium is present at a position closer to the binder phase than the maximum concentration region of vanadium.

The relationship $P_{W70}<P_V$ shows that the maximum concentration region of vanadium located at the distance $P_V$ is located outside the WC particles and not inside the WC particles. The relationship $P_{Cr}<P_{Co70}$ shows that the maximum concentration region of chromium is located outside the binder phase and not inside the binder phase. From these, the relationship $P_{W70}<P_V<P_{Cr}<P_{Co70}$ shows that the maximum concentration region of vanadium and the maximum concentration region of chromium are present in the interface region between the WC particles and the binder phase.

In the present disclosure, line analysis of the cemented carbide and acquisition of the first graph based on the analysis results are carried out by the following procedure. The cemented carbide is sliced into a thickness of 30 to 100 nm by using an argon ion slicer ("Cryo Ion Slicer IB-09060BCIS" (trademark) manufactured by JEOL Ltd.) under conditions of an acceleration voltage of 6 kV and a finish acceleration voltage of 2 kV to make a sample for measurement. Next, the sample for measurement is observed at a magnification of 200000 times by using a TEM (Transmission Electron Microscopy) ("JEM-ARM300F2" (trademark) manufactured by JEOL Ltd.) under a condition of an acceleration voltage of 200 V to obtain a first image (not shown).

On the first image, the tungsten carbide particles are observed as white regions, the binder phase is observed as a black region. On the first image, the interface between the tungsten carbide particles and the binder phase is arbitrarily selected.

Next, the selected interface is positioned such that it passes through the vicinity of the center of the image, the observation magnification is adjusted such that the field of view size is 5 nm×5 nm, and observation is carried out to obtain a second image (not shown). On the second image, the extension direction in which the interface extends is confirmed. Line analysis is carried out by using an energy dispersive X-ray spectrometer (TEM-EDX) attached to a transmission electron microscope along a first direction perpendicular to the extension direction and going from position X1 provided in the tungsten carbide particles to position X2 provided in the binder phase adjacent to the tungsten carbide particles to measure the distributions of tungsten, cobalt, vanadium, and chromium. Here, the term direction perpendicular to the extension direction of the interface means the direction along a straight line that intersects the tangent to the extension direction at an angle of 90°±5°. The conditions for carrying out EDX are an acceleration voltage of 200 kV, a camera length of 10 cm, a pixel count of 128×128 pixels, and a dwell time of 0.02 to 3 s/pixel.

The measurement results of each of tungsten, cobalt, vanadium, and chromium are shown in a coordinate system where the X axis is the distance from position X1 and the Y axis is the intensity, to obtain a first graph.

For the cemented carbide, first images of five fields of view that do not overlap with each other are arbitrarily acquired, and the above analysis is carried out based on each of the first images to obtain five first graphs. When the relationship $P_W<P_{W70}<P_V<P_{Cr}<P_{Co70}<P_{Co}$ is shown in the first regions of four or more first graphs, it is determined that the relationship $P_W<P_{W70}<P_V<P_{Cr}<P_{Co70}<P_{Co}$ is shown in the first region of the first graph for the cemented carbide. In order to obtain this criterion, the present inventors carried out a plurality of line analyses on each of a plurality of cemented carbides. As a result, the present inventors confirmed that among these cemented carbides, a cemented carbide in which the relationship $P_W<P_{W70}<P_V<P_{Cr}<P_{Co70}<P_{Co}$ was shown in 80% or more of the first graphs exhibited the effect of the present disclosure. In consideration of the method for manufacturing the cemented carbide, it is presumed that the existence forms of vanadium and chromium in the interface region between the WC particles and the binder phase are almost the same within the same cemented carbide.

Figure 3:
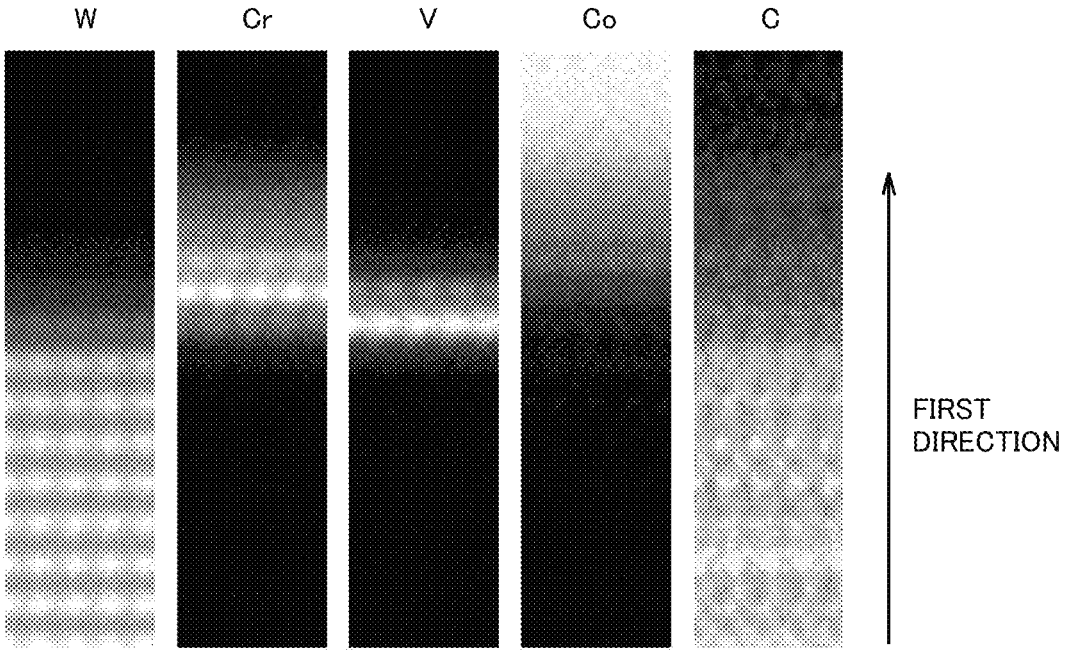
FIG. 3 is a high-angle annular dark field (HAADF) image of a cross section of the cemented carbide.

The relationship $P_W<P_{W70}<P_V<P_{Cr}<P_{Co70}<P_{Co}$, and the positional relationship among the WC particles, the maximum concentration region of vanadium, the maximum concentration region of chromium, and the binder phase in the cemented carbide can also be confirmed in an HAADF (high-angle annular dark field) image of a cross section of the cemented carbide. FIG. 3 shows a cemented carbide region shown in the graph of FIG. 2 and HAADF images of the same region. In the HAADF images shown in FIG. 3, a higher atomic concentration shows a higher brightness.

The image indicated by W in FIG. 3 is an HAADF image showing the distribution of tungsten atoms. In the image indicated by W in FIG. 3, the region having the highest brightness corresponds to the region of the WC particles.

The image indicated by Cr in FIG. 3 is an HAADF image showing the distribution of chromium atoms. In the image indicated by Cr in FIG. 3, the region having the highest brightness corresponds to the maximum concentration region of chromium.

The image indicated by V in FIG. 3 is an HAADF image showing the distribution of vanadium atoms. In the image indicated by V in FIG. 3, the region having the highest brightness corresponds to the maximum concentration region of vanadium.

The image indicated by Co in FIG. 3 is an HAADF image showing the distribution of cobalt atoms. In the image indicated by Co in FIG. 3, the region having the highest brightness corresponds to the binder phase region.

From the images of W, Cr, V, and C in FIG. 3, it is confirmed that in the first region including the interface between the WC particles and the binder phase, the maximum concentration region of vanadium is located closer to the WC particles than the maximum concentration region of chromium, and that the maximum concentration region of chromium is located closer to the binder phase than the maximum concentration region of vanadium.

From the images of W and V in FIG. 3, it is confirmed that the maximum concentration region of vanadium is located outside the tungsten carbide particles and not inside the tungsten carbide particles. From the images of Cr and Co in FIG. 3, it is confirmed that the maximum concentration region of chromium is located outside the binder phase and not inside the binder phase. From these, it is confirmed that in the cemented carbide shown in FIG. 3, the maximum concentration region of vanadium and the maximum concentration region of chromium are present in the interface region between the WC particles and the binder phase.

In the first region of the first graph for the cemented carbide of Embodiment 1, the vanadium atom located at the distance $P_V$ at the maximum intensity $I_V$ of vanadium and the chromium atom located at the distance $P_{Cr}$ at the maximum intensity $I_{Cr}$ of chromium may be present at a W site of tungsten carbide. The method for confirming this will be described with reference to FIG. 4.

Figure 4:
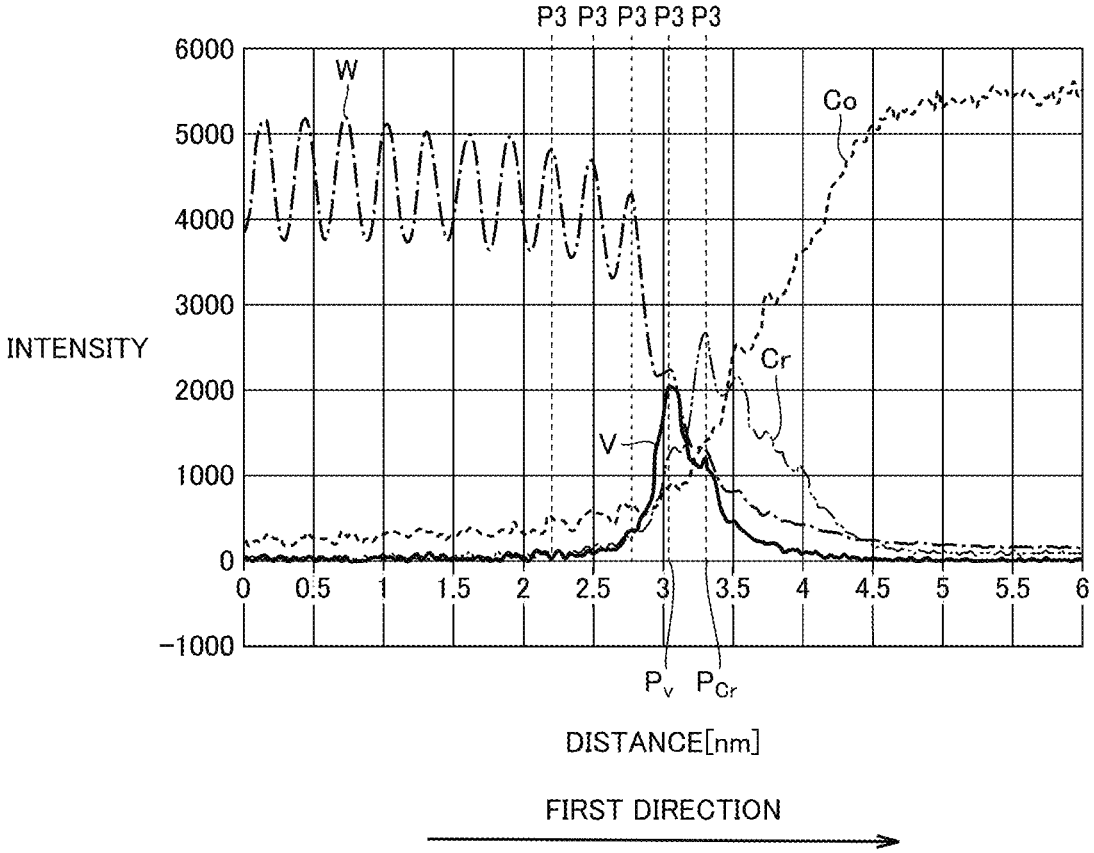
FIG. 4 is a diagram for describing a method for confirming that a vanadium atom and a chromium atom are present at a C site of tungsten carbide.

FIG. 4 is the same graph as the first graph shown in FIG. 2. In at least a part of the first graph, peaks of tungsten are periodically present along the X axis. The average period of the peaks of tungsten is determined based on the portion in which the period is clearly found. Based on the average period, peak positions P3 of tungsten are entered on the first graph. In the present disclosure, peak positions P3 correspond to the positions of W sites. In the present disclosure, a C site is present between adjacent peak positions P3.

The distance $P_V$ at the maximum intensity $I_V$ of vanadium and the distance $P_{Cr}$ at the maximum intensity $I_{Cr}$ of chromium are specified in the first graph. In the first graph, when a peak position P3 of tungsten and the distance $P_V$ at the maximum intensity $I_V$ of vanadium overlap, it is confirmed that the vanadium atom located at $P_V$ is present at a W site of tungsten carbide. In the first graph, when a peak position P3 of tungsten and the distance $P_{Cr}$ at the maximum intensity $I_{Cr}$ of chromium overlap, it is confirmed that the chromium atom located at $P_{Cr}$ is present at a W site of tungsten carbide.

In the first region of the first graph for the cemented carbide of Embodiment 1, the vanadium atom located at the distance $P_V$ at the maximum intensity $I_V$ of vanadium and the chromium atom located at the distance $P_{Cr}$ at the maximum intensity $I_{Cr}$ of chromium are present at a W site of tungsten carbide and may be absent at a C site.

<Method for Manufacturing Cemented Carbide>

The cemented carbide of the present embodiment can be manufactured by carrying out a raw material powder preparing step, a mixing step, a compacting step, a sintering step, and an HIP (Hot Isostatic Pressing) step in presented order. Hereinafter, each step will be described.

<Preparing Step>

The preparing step is a step for preparing raw material powders of materials that constitute a cemented carbide material. Examples of the raw material powders include a tungsten carbide powder (hereinafter also referred to as a "WC powder"), a cobalt (Co) powder, a vanadium carbide (VC) powder, and a chromium carbide ($Cr_3C_2$) powder. In addition to these raw material powders, a nickel (Ni) powder, a tungsten carbide (TaC) powder, a titanium carbonitride (TiCN) powder, or the like can be prepared. As these raw material powders, commercially available ones can be used. The average particle diameter of these raw material powders is not particularly limited, and can be, for example, 0.1 to 3.0 μm. The term average particle diameter of a raw material powder means the average particle diameter measured by the FSSS (Fisher Sub-Sieve Sizer) method. The average particle diameter is measured by using "Sub-Sieve Sizer Model 95" (trademark) manufactured by Fisher Scientific.

<Mixing Step>

The mixing step is mixing raw material powders prepared in the preparing step at predetermined proportions. A mixed powder in which raw material powders are mixed is obtained by the mixing step. The mixing proportions of raw material powders are appropriately adjusted according to the intended composition of the cemented carbide.

The mixing of raw material powders can be carried out by using a conventionally known mixing method such as an attritor, a ball mill, or a bead mill. As the mixing conditions, conditions that are conventionally known again can be used. The mixing time can be, for example, 2 hours or more and 20 hours or less.

After the mixing step, the mixed powder may be granulated as needed. By granulating the mixed powder, it is easy to fill a die or a mold with the mixed powder during the compacting step described later. A known granulation method can be applied to the granulation, and for example, a commercially available granulator such as a spray dryer can be used.

<Compacting Step>

The compacting step is a step for compacting the mixed powder obtained in the mixing step into a shape for a cutting tool (for example, a round bar shape) to obtain a compact. As the compacting method and the compacting conditions in the compacting step, a general method and general conditions may be adopted, and these are not particularly limited.

<Sintering Step>

The sintering step is a step of obtaining a cemented carbide intermediate by sintering and then cooling the compact obtained through the compacting step. The sintering conditions in the present embodiment are as follows. First, the compact is placed in an argon (Ar) atmosphere with a pressure of 2 kPa, and the compact is heated to 900° C. and held at 900° C. for 60 minutes (hereinafter also referred to as "first sintering"). Next, in an argon (Ar) atmosphere with a pressure of 2 kPa, the compact is heated to 1100° C. and held at 1100° C. for 60 minutes (hereinafter also referred to as "second sintering"). Next, under vacuum, the compact is heated to 1350° C. and held at 1350° C. for 60 minutes (hereinafter also referred to as "third sintering"). Next, the compact is cooled. For example, the compact is cooled to 25° C. in Ar gas under a condition of a pressure of 100 to 400 MPaG. Thereby, a cemented carbide intermediate is obtained.

<HIP Step>

The HIP step is a step of subjecting the cemented carbide intermediate to HIP treatment. The HIP conditions in the present embodiment are as follows. First, a temperature of 1250° C. and a pressure of 10 MPa are applied to the cemented carbide intermediate and held for 30 minutes (hereinafter also referred to as "first HIP"). Next, a temperature of 1350° C. and a pressure of 200 MPa are applied to the cemented carbide intermediate and held for 30 minutes (hereinafter also referred to as "second HIP"). Thereby, a cemented carbide of Embodiment 1 can be obtained.

<Characteristics of Method for Manufacturing Cemented Carbide According to the Present Embodiment>

In the present embodiment, the sintering step is carried out in three stages including the first sintering, the second sintering, and the third sintering. Furthermore, the HIP step is carried out in two stages including the first HIP and the second HIP. It is presumed that by these steps, the obtained cemented carbide shows the relationship $P_W<P_{W70}<P_V<P_{Cr}<P_{Co70}<P_{Co}$ in the first region of the first graph therefor. It has been newly found as a result of extensive studies by the present inventors that the cemented carbide of the present disclosure can be realized by such sintering conditions and HIP conditions. The sintering conditions and the HIP conditions used in the present embodiment would reduce production efficiency and thus were not adopted by those skilled in the art.

In a conventional general method for manufacturing a cemented carbide, the sintering step is carried out in one stage, in which the temperature is raised to a predetermined temperature and then maintained for a predetermined time. In addition, in a conventional general method for manufacturing a cemented carbide, after the sintering step, no HIP step is carried out, or even if an HIP step is carried out, it is carried out in one stage, involving maintaining at a predetermined temperature and pressure for a predetermined time. In the cemented carbide obtained by the conventional method for manufacturing a cemented carbide, vanadium and chromium are randomly disposed in the interface region between the WC particles and the binder phase, and the cemented carbide does not show the relationship $P_W<P_{W70}<P_V<P_{Cr}<P_{Co70}<P_{Co}$ in the first region of the first graph therefor.

Embodiment 2: Cutting Tool

The cutting tool of the present embodiment includes a cutting edge formed from the cemented carbide of Embodiment 1. In the present disclosure, the term cutting edge means a portion involved in cutting. More specifically, the term cutting edge means a region surrounded by a cutting edge ridgeline and a virtual plane having a distance of 0.5 mm or 2 mm from the cutting edge ridgeline to the cemented carbide side.

Figure 5:
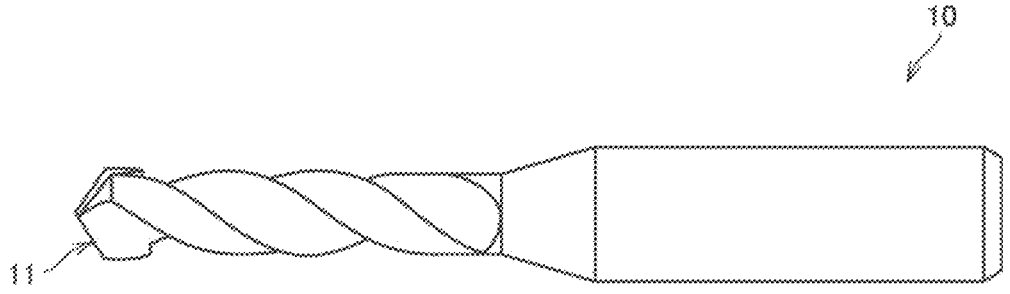
FIG. 5 is a schematic view of a cutting tool according to Embodiment 2.

Examples of the cutting tool include a cutting bit, a drill, an end mill, an indexable cutting insert for milling working, an indexable cutting insert for turning working, a metal saw, a gear cutting tool, a reamer, and a tap. In particular, as shown in FIG. 5, a cutting tool 10 of the present embodiment can exhibit an excellent effect in the case of a small-diameter drill for working a printed circuit board. A cutting edge 11 of cutting tool 10 shown in FIG. 3 is formed from the cemented carbide of Embodiment 1.

The cemented carbide of the present embodiment may constitute the whole of each of these tools, or a part thereof. Here, the term "constituting a part" refers to, for example, a mode of forming a cutting edge portion by brazing the cemented carbide of the present embodiment at a predetermined position of an arbitrary base material.

The cutting tool of the present embodiment may further include a hard film that coats at least a part of the surface of the base material formed from the cemented carbide. For example, diamond-like carbon or diamond can be used as the hard film.

The cutting tool of the present embodiment can be obtained by compacting the cemented carbide of Embodiment 1 into a desired shape.

EXAMPLES

The present embodiment will be described more specifically with reference to Examples. However, the present embodiment is not limited by these Examples.

[Making Cemented Carbide]

A cemented carbide of each sample was made by the following procedure.

A WC powder (average particle diameter of 0.3 μm), a Co powder (average particle diameter of 1.0 μm), a VC powder, a $Cr_3C_2$ powder, a TaC powder, a TiCN powder were prepared in the proportions shown in the "Raw material powders" column of Table 1 and Table 2, and mixed with an attritor to obtain mixed powders. The mixing conditions were a rotation speed of 300 rpm and 180 minutes. The average particle diameters of the VC powder, the $Cr_3C_2$ powder, the TaC powder, and the TICN powder were 0.1 to 3.0 μm.

[Table 1]

TABLE 1

| | Raw material powders | | | | | |
|---|---|---|---|---|---|---|
| Sample No. | WC % by mass | Co % by mass | $Cr_3C_2$ % by mass | VC % by mass | TaC % by mass | TiCN % by mass |
| 1 | 91.83 | 0.07 | 0.05 | 0.05 | — | 8.00 |
| 2 | 89.28 | 0.07 | 2.60 | 0.05 | — | 8.00 |

TABLE 1-continued

| Sample No. | Raw material powders | | | | | |
|---|---|---|---|---|---|---|
| | WC % by mass | Co % by mass | $Cr_3C_2$ % by mass | VC % by mass | TaC % by mass | TiCN % by mass |
| 3 | 90.98 | 0.07 | 0.05 | 0.90 | — | 8.00 |
| 4 | 99.86 | 0.05 | 0.05 | 0.04 | — | — |
| 5 | 97.71 | 0.05 | 2.20 | 0.04 | — | — |
| 6 | 99.10 | 0.05 | 0.05 | 0.80 | — | — |
| 7 | 96.30 | 3.00 | 0.50 | 0.20 | — | — |
| 8 | 92.20 | 6.50 | 0.90 | 0.40 | — | — |
| 9 | 88.50 | 9.50 | 1.40 | 0.60 | — | — |
| 10 | 85.40 | 12.00 | 1.80 | 0.80 | — | — |
| 11 | 66.91 | 13.00 | 0.05 | 0.04 | 20.00 | — |
| 12 | 62.46 | 13.00 | 2.50 | 0.04 | 22.00 | — |
| 13 | 71.05 | 13.00 | 0.05 | 0.90 | 10.00 | 5.00 |
| 14 | 86.91 | 13.00 | 0.05 | 0.04 | — | — |
| 15 | 84.56 | 13.00 | 2.40 | 0.04 | — | — |
| 16 | 86.15 | 13.00 | 0.05 | 0.80 | — | — |
| 17 | 84.10 | 13.00 | 1.80 | 1.10 | — | — |
| 18 | 85.87 | 13.00 | 0.03 | 1.10 | — | — |

[Table 2]

TABLE 2

| Sample No. | Raw material powders | | | | | |
|---|---|---|---|---|---|---|
| | WC % by mass | Co % by mass | $Cr_3C_2$ % by mass | VC % by mass | TaC % by mass | TiCN % by mass |
| 101 | 91.83 | 0.07 | 0.05 | 0.05 | — | 8.00 |
| 102 | 89.28 | 0.07 | 2.60 | 0.05 | — | 8.00 |
| 103 | 90.98 | 0.07 | 0.05 | 0.90 | — | 8.00 |
| 104 | 99.86 | 0.05 | 0.05 | 0.04 | — | — |
| 105 | 97.71 | 0.05 | 2.20 | 0.04 | — | — |
| 106 | 99.10 | 0.05 | 0.05 | 0.80 | — | — |
| 107 | 96.30 | 3.00 | 0.50 | 0.20 | — | — |
| 108 | 92.20 | 6.50 | 0.90 | 0.40 | — | — |
| 109 | 88.50 | 9.50 | 1.40 | 0.60 | — | — |
| 110 | 85.40 | 12.00 | 1.80 | 0.80 | — | — |
| 111 | 66.91 | 13.00 | 0.05 | 0.04 | 20.00 | — |
| 112 | 62.46 | 13.00 | 2.50 | 0.04 | 22.00 | — |
| 113 | 71.05 | 13.00 | 0.05 | 0.90 | 10.00 | 5.00 |
| 114 | 86.91 | 13.00 | 0.05 | 0.04 | — | — |
| 115 | 84.56 | 13.00 | 2.40 | 0.04 | — | — |
| 116 | 86.15 | 13.00 | 0.05 | 0.80 | — | — |
| 117 | 80.10 | 17.00 | 2.00 | 0.90 | — | — |
| 118 | 83.40 | 15.90 | 0.20 | 0.50 | — | — |
| 119 | 64.90 | 6.40 | 0.20 | 0.50 | 28.00 | — |
| 120 | 85.60 | 13.00 | 0.20 | 1.20 | — | — |
| 121 | 80.30 | 13.00 | 5.70 | 1.00 | — | — |

Next, the mixed powders were each pressed to fabricate a round bar-shaped compact. Next, the compact was sintered and then cooled to obtain a cemented carbide intermediate.

The sintering conditions for sample 1 to sample 18 are as follows. First, the compact was placed in an argon (Ar) atmosphere with a pressure of 2 kPa, and the compact was heated to 900° C. and held at 900° C. for 60 minutes (first sintering). Next, in an argon (Ar) atmosphere with a pressure of 2 kPa, the compact was heated to 1100° C. and held at 1100° C. for 60 minutes (second sintering). Next, under vacuum, the compact was heated to 1350° C. and held at 1350° C. for 60 minutes (third sintering). Next, the compact was cooled to 25° C. in Ar gas under a condition of a pressure of 200 MPaG. Thereby, a cemented carbide intermediate was obtained.

The sintering conditions for sample 101 to sample 121 are as follows. Under vacuum, the compact was heated to 1350° C. and held at 1350° C. for 60 minutes. Next, the compact was cooled to 25° C. in Ar gas under a condition of a pressure of 400 kPaG. Thereby, a cemented carbide intermediate was obtained.

Next, the cemented carbide intermediates were subjected to HIP treatment to obtain a cemented carbide of each sample.

The HIP conditions for sample 1 to sample 18 are as follows. First, a temperature of 1250° C. and a pressure of 10 MPa were applied to the cemented carbide intermediates and held for 30 minutes (first HIP). Next, a temperature of 1350° C. and a pressure of 200 MPa were applied to the cemented carbide intermediates and held for 30 minutes (second HIP). Thereby, cemented carbides of sample 1 to sample 18 were obtained.

The HIP conditions for sample 101 to sample 121 are as follows. A temperature of 1300° C. and a pressure of 10 MPa were applied to the cemented carbide intermediates and held for 60 minutes. Thereby, cemented carbides of sample 101 to sample 121 were obtained.

[Fabrication of Cutting Tool]

A round bar formed from the cemented carbide obtained was worked to fabricate a drill for working a printed circuit board (PCB (Printed Circuit Board) drill) having an edge diameter of φ0.15 mm.

[Evaluation of Cemented Carbide]

<Content (% by Volume) of Tungsten Carbide Particles in Cemented Carbide and Content (% by Volume) of Binder Phase>

The content (% by volume) of the tungsten carbide particles in the cemented carbide and the content (% by volume) of the binder phase of each sample were measured. A specific measuring method is as described in Embodiment 1. Results thereof are shown in the "WC particle content" and "Binder phase content" columns of "Cemented carbide" of Table 3 and Table 4. Further, the sum of the content of the tungsten carbide particles and the content of the binder phase in the cemented carbide is shown in the "WC particle+binder phase content" column of "Cemented carbide" of Table 3 and Table 4. It was confirmed that cemented carbides with less than 100% by volume in the "WC particle+binder phase content" column of Table 3 and Table 4 included TiCN, TiC, or the like.

<Cobalt Content of Binder Phase>

In the cemented carbide of each sample, the cobalt content of the binder phase was measured. A specific measuring method is as described in Embodiment 1. Results thereof are shown in the "Co content of binder phase" column of "Cemented carbide" of Table 3 and Table 4. It was confirmed that binder phases with less than 100% by mass in the "Co content of binder phase" column of Table 3 and Table 4 included an unavoidable impurity such as Ni.

<Vanadium Content and Chromium Content of Cemented Carbide>

In the cemented carbide of each sample, the vanadium content and chromium content of the cemented carbide were measured. A specific measuring method is as described in Embodiment 1. Results thereof are shown in the "V content" and "Cr content" columns of "Cemented carbide" of Table 3 and Table 4.

<Line Analysis>

The cemented carbide of each sample was subjected to the line analysis shown in Embodiment 1 to obtain a first graph. In the first graph for each sample, it was checked whether the distance $P_W$ at the maximum intensity $I_W$ of tungsten, the maximum distance $P_{W70}$ showing an intensity $I_{W70}$ of 70% of the maximum intensity $I_W$, the distance $P_V$ at the maximum intensity $I_V$ of vanadium, the distance $P_{Cr}$ at the maximum intensity $I_{Cr}$ of chromium, the minimum distance $P_{Co70}$ showing an intensity $I_{Co70}$ of 70% of the maximum intensity $I_{Co}$ of cobalt, and the distance $P_{Co}$ at the maximum intensity $I_{Co}$ showed the relationship $P_W<P_{W70}<P_V<P_{Cr}<P_{Co70}<P_{Co}$. Results thereof are shown in the "Peak order" column of Table 3 and Table 4. "Yes" means that the relationship $P_W<P_{W70}<P_V<P_{Cr}<P_{Co70}<P_{Co}$ is shown, and "No" means that the relation $P_W<P_{W70}<P_V<P_{Cr}<P_{Co70}<P_{Co}$ is not shown.

Based on the first graph for each sample, by the method described in Embodiment 1, the site at which the vanadium atom located at the distance $P_V$ at the maximum intensity $I_V$ of vanadium, and the chromium atom located at the distance $P_{Cr}$ at the maximum intensity $I_{Cr}$ of chromium were present was confirmed. Results thereof are shown in the "Site at which V and Cr were present" column of Table 3 and Table 4. In the "Site at which V and Cr were present" column, "W" shows that a vanadium atom and a chromium atom are present at a W site of tungsten carbide. In the "Site at which V and Cr were present" column, "W, C" shows that a vanadium atom and a chromium atom are present at both a W site and a C site of tungsten carbide.

[Table 3]

TABLE 3

| | Cemented carbide | | | | | | | | Cutting |
|---|---|---|---|---|---|---|---|---|---|
| Sample No. | WC particle content % by volume | Binder phase content % by volume | WC particle + binder phase content % by volume | Co content of binder phase % by mass | V content Atomic % | Cr content Atomic % | Peak order Yes/No | Site at which V and Cr were present | test Number of broken drills |
| 1 | 79.9 | 0.1 | 80.0 | 50.0 | 0.04 | 0.02 | Yes | W | 2 |
| 2 | 79.9 | 0.1 | 80.0 | 50.0 | 0.04 | 0.82 | Yes | W | 1 |
| 3 | 79.9 | 0.1 | 80.0 | 50.0 | 0.78 | 0.02 | Yes | W | 1 |
| 4 | 99.9 | 0.1 | 100.0 | 50.0 | 0.03 | 0.02 | Yes | W | 1 |
| 5 | 99.9 | 0.1 | 100.0 | 50.0 | 0.04 | 0.69 | Yes | W | 0 |
| 6 | 99.9 | 0.1 | 100.0 | 50.0 | 0.69 | 0.02 | Yes | W | 0 |
| 7 | 95.0 | 5.0 | 100.0 | 100.0 | 0.17 | 0.15 | Yes | W | 0 |
| 8 | 90.0 | 10.0 | 100.0 | 100.0 | 0.35 | 0.28 | Yes | W | 0 |
| 9 | 85.0 | 15.0 | 100.0 | 100.0 | 0.52 | 0.43 | Yes | W | 0 |
| 10 | 82.0 | 18.0 | 100.0 | 100.0 | 0.69 | 0.56 | Yes | W | 0 |
| 11 | 60.0 | 20.0 | 80.0 | 50.0 | 0.03 | 0.02 | Yes | W | 1 |
| 12 | 60.0 | 20.0 | 80.0 | 50.0 | 0.03 | 0.78 | Yes | W | 0 |
| 13 | 60.0 | 20.0 | 80.0 | 50.0 | 0.78 | 0.02 | Yes | W | 0 |
| 14 | 80.0 | 20.0 | 100.0 | 100.0 | 0.03 | 0.02 | Yes | W | 0 |
| 15 | 80.0 | 20.0 | 100.0 | 100.0 | 0.03 | 0.74 | Yes | W | 0 |
| 16 | 80.0 | 20.0 | 100.0 | 100.0 | 0.68 | 0.02 | Yes | W | 0 |
| 17 | 80.0 | 20.0 | 100.0 | 100.0 | 0.90 | 1.20 | Yes | W | 0 |
| 18 | 80.0 | 20.0 | 100.0 | 100.0 | 0.90 | 0.01 | Yes | W | 0 |

[Table 4]

TABLE 4

| | Cemented carbide | | | | | | | | Cutting |
|---|---|---|---|---|---|---|---|---|---|
| Sample No. | WC particle content % by volume | Binder phase content % by volume | WC particle + binder phase content % by volume | Co content of binder phase % by mass | V content Atomic % | Cr content Atomic % | Peak order Yes/No | Site at which V and Cr were present | test Number of broken drills |
| 101 | 79.9 | 0.1 | 80.0 | 50.0 | 0.04 | 0.02 | No | W, C | 9 |
| 102 | 79.9 | 0.1 | 80.0 | 50.0 | 0.04 | 0.82 | No | W, C | 8 |
| 103 | 79.9 | 0.1 | 80.0 | 50.0 | 0.78 | 0.02 | No | W, C | 7 |
| 104 | 99.9 | 0.1 | 100.0 | 50.0 | 0.03 | 0.02 | No | W, C | 7 |
| 105 | 99.9 | 0.1 | 100.0 | 50.0 | 0.04 | 0.69 | No | W. C | 6 |
| 106 | 99.9 | 0.1 | 100.0 | 50.0 | 0.69 | 0.02 | No | W, C | 6 |
| 107 | 95.0 | 5.0 | 100.0 | 100.0 | 0.17 | 0.15 | No | W, C | 7 |
| 108 | 90.0 | 10.0 | 100.0 | 100.0 | 0.35 | 0.28 | No | W, C | 7 |
| 109 | 85.0 | 15.0 | 100.0 | 100.0 | 0.52 | 0.43 | No | W, C | 7 |
| 110 | 82.0 | 18.0 | 100.0 | 100.0 | 0.69 | 0.56 | No | W, C | 7 |
| 111 | 60.0 | 20.0 | 80.0 | 50.0 | 0.03 | 0.02 | No | W, C | 8 |
| 112 | 60.0 | 20.0 | 80.0 | 50.0 | 0.03 | 0.78 | No | W. C | 6 |
| 113 | 60.0 | 20.0 | 80.0 | 50.0 | 0.78 | 0.02 | No | W, C | 6 |
| 114 | 80.0 | 20.0 | 100.0 | 100.0 | 0.03 | 0.02 | No | W, C | 6 |
| 115 | 80.0 | 20.0 | 100.0 | 100.0 | 0.03 | 0.74 | No | W, C | 6 |
| 116 | 80.0 | 20.0 | 100.0 | 100.0 | 0.68 | 0.02 | No | W, C | 6 |
| 117 | 75.0 | 25.0 | 100.0 | 100.0 | 0.78 | 0.62 | No | W, C | 6 |
| 118 | 75.0 | 25.0 | 100.0 | 100.0 | 0.43 | 0.06 | No | W, C | 6 |
| 119 | 60.0 | 10.0 | 70.0 | 100.0 | 0.43 | 0.06 | No | W. C | 7 |
| 120 | 80.0 | 20.0 | 100.0 | 100.0 | 1.03 | 0.06 | No | W. C | 7 |
| 121 | 80.0 | 20.0 | 100.0 | 100.0 | 0.89 | 1.81 | No | W, C | 7 |

[Evaluation of Cutting Tool]

<Cutting Test>

By using a PCB drill of each sample, a commercially available printed circuit board for a semiconductor package was subjected to drill working to evaluate the tool life. The printed circuit board is a stack of three boards each having a thickness of 0.4 mm. The drill working conditions were a rotation speed of 150 krpm, a feed speed of 3 m/min, and a drawing speed of 25 m/min. 10 PCB drills of each sample were prepared, drill working was carried out by using each of the drills, and the number of broken drills was counted after 10,000 hits. Results thereof are shown in the "Number of broken drills" column of "Cutting test" of Table 3 and Table 4. A smaller number of broken drills shows better drill breakage resistance and a longer tool life.

DISCUSSION

The cemented carbides and cutting tools of sample 1 to sample 18 correspond to Examples. The cemented carbides and cutting tools of sample 101 to sample 121 correspond to Comparative Examples. It was confirmed that the cutting tools of sample 1 to sample 18 (Examples) had a longer tool life than the cutting tools of sample 101 to sample 121 (Comparative Examples). It is presumed that this is because the cemented carbides of sample 1 to sample 16 have excellent breakage resistance.

The embodiments and the Examples of the present disclosure have been described as above, and it is also planned from the beginning to appropriately combine the configurations of the embodiments and the Examples described above and to modify these in various ways.

The embodiments and the Examples disclosed this time should be considered to be illustrative in all respects and non-limiting. The scope of the present invention is defined by the Claims, not by the above embodiments and Examples, and is intended to include all modifications within the meaning and scope equivalent to the Claims.

REFERENCE SIGNS LIST

1 tungsten carbide particle, 2 binder phase, 3 cemented carbide, 10 cutting tool, 11 cutting edge

The invention claimed is:

1. A cemented carbide comprising a plurality of tungsten carbide particles and a binder phase, wherein the cemented carbide comprises a total of 80% by volume or more of the tungsten carbide particles and the binder phase, the cemented carbide comprises 0.1% by volume or more and 20% by volume or less of the binder phase, the cemented carbide comprises 0.03 atomic % or more and 0.90 atomic % or less of vanadium, the cemented carbide comprises 0.01 atomic % or more and 1.20 atomic % or less of chromium, and the binder phase comprises 50% by mass or more of cobalt, and wherein in a first region of a first graph showing results obtained by carrying out line analysis by using an energy dispersive X-ray spectrometer attached to a transmission electron microscope along a first direction going from position X1 provided in the tungsten carbide particles to position X2 provided in the binder phase adjacent to the tungsten carbide particles, in a coordinate system where an X axis is a distance from position X1 and a Y axis is an intensity, a distance $P_W$ at a maximum intensity $I_W$ of tungsten, a maximum distance $P_{W70}$ showing an intensity $I_{W70}$ of 70% of the maximum intensity $I_W$, a distance $P_V$ at a maximum intensity $I_V$ of vanadium, a distance $P_{Cr}$ at a maximum intensity $I_{Cr}$ of chromium, a minimum distance $P_{Co70}$ showing an intensity $I_{Co70}$ of 70% of a maximum intensity $I_{Co}$ of cobalt, and a distance $P_{Co}$ at the maximum intensity $I_{Co}$ show a relationship, and the first region is a region between a distance P1, which is a distance of 3 nm from the $P_V$ toward an origin side of the coordinate system, and a distance P2, which is a distance of 3 nm from the $P_V$ toward an opposite side of the origin, on the X axis in the first graph.

2. The cemented carbide according to claim 1, wherein a vanadium atom located at the $P_V$ and a chromium atom located at the $P_{Cr}$ are present at a W site of tungsten carbide.

3. The cemented carbide according to claim 1, wherein the cemented carbide comprises 18% by volume or less of the binder phase.

4. A cutting tool comprising a cutting edge formed from the cemented carbide according to claim 1.

5. The cemented carbide according to claim 2, wherein the cemented carbide comprises 18% by volume or less of the binder phase.

6. A cutting tool comprising a cutting edge formed from the cemented carbide according to claim 2.

7. A cutting tool comprising a cutting edge formed from the cemented carbide according to claim 3.

8. A cutting tool comprising a cutting edge formed from the cemented carbide according to claim 5.

* * * * *